United States Patent [19]

Hersker

[11] Patent Number: 4,809,399

[45] Date of Patent: Mar. 7, 1989

[54] LATCH HOOK RUG HOLDER

[76] Inventor: Lee H. Hersker, Box 802, Conyngham, Pa. 18219

[21] Appl. No.: 867,930

[22] Filed: May 29, 1986

[51] Int. Cl.[4] ..... A47G 27/04

[52] U.S. Cl. ..... 16/8; 269/6; 81/302; 294/28; 294/8.6

[58] Field of Search ..... 16/4, 5, 8, 17; 294/8.6, 106, 104, 28, 31.1; 269/6, 254 R, 238; 81/300, 302, 418, 427; 7/103

[56] References Cited

U.S. PATENT DOCUMENTS

| | | | |
|---|---|---|---|
| 1,221,042 | 4/1917 | Frankell | 296/6 |
| 1,532,376 | 4/1925 | Carr | 269/6 |
| 2,120,148 | 6/1938 | Kallmann | 294/28 |
| 2,562,055 | 7/1951 | Miller | 81/300 |
| 3,540,106 | 11/1970 | Goldman | 81/302 |
| 3,654,755 | 4/1972 | Bell | 81/302 |
| 3,659,331 | 5/1972 | Drake | 294/8.6 |

*Primary Examiner*—Kurt Rowan
*Attorney, Agent, or Firm*—Anthony J. Dixon

[57] ABSTRACT

A latch hook rug holder for use in the construction and completion of latch-hook rugs whereby the work-piece can be releasedly attached to a table for ease of completion.

6 Claims, 1 Drawing Sheet

LATCH HOOK RUG HOLDER

BACKGROUND OF THE INVENTION

1. Field of the Invention

The present invention relates to the field of latch hook rugs, more particularly it relates to a holder for said rugs to facilitate work on said rugs. More particularly it relates to a device for holding a rug base to facilitate working on the rug by the maker.

2. The Prior Art

In the construction of latch hook rugs, it is most difficult for the maker to hold the base material while threading the yarn to be applied to the base material.

Various thread guides, bobbins and the like are known, as are set forth in U.S. Pat. No. 67,524 issued to Froelich in 1867 which relates to a holder for thread in the use of button hole processes with sewing machines. Yet the present problem being addressed is quite unique from that faced by Froelich.

Other references such as U.S. Pat. No. 290,658 issued to Appleby and U.S. Pat. No. 736,130 issued to Mitchell disclose various thread guides yet the construction or application of the present invention are not disclosed by these references.

It is therefore, an object of the present invention to provide a rug holder for material which facilities its accessibility to the worker.

It is a further object of the present invention to provide a holder for use in the field of sewing and crafts generally.

It is a further object of the present invention to provide a unique clamp to be used as a latch-hook rug holder which holds the work-piece in a location convenient to the worker in a fashion presently not disclosed in the art.

It is a further object of the present invention to provide a solution to a long standing problem in the latch-hook rug art, to provide a holder for the work-piece which does not interfere with the worker.

These and other objects and advantages of the present invention will be more readily apparent upon review of the drawings and description of the preferred embodiment which follows.

SUMMARY OF THE INVENTION

These and other objects and advantages are achieved with the device of the present invention which comprise a. A first handle portion comprising a body and a clamp b. a second opposing L-shaped handle portion pivotally connected to said first handle portion comprised of a body portion and a clamp portion c. a spring disposed between said first and second handle portions which resists opening of the opposing clamp portions of each handle d. a two sided opening defined in the second handle portion with a slot-type configuration on its outer edge and a cross-shaped configuration on its inner edge e. a stud member comprising a body, top flange and bottom flange where the bottom flange is accommodatingly smaller than the outer edge opening of the above.

f. a spring member circumferentially disposed along the stud g. a washer portion around the stud between the spring and the bottom flange, said washer of a cross-section larger than the outer edge opening Whereby a work-piece can be releaseably attached to a table by passing stud through the work-piece, attaching the stud to a body of the device and releaseably attaching the device to a work table.

THE PREFERRED EMBODIMENT

With reference to the above drawings, the device of the present invention can best be described.

Figure 1:
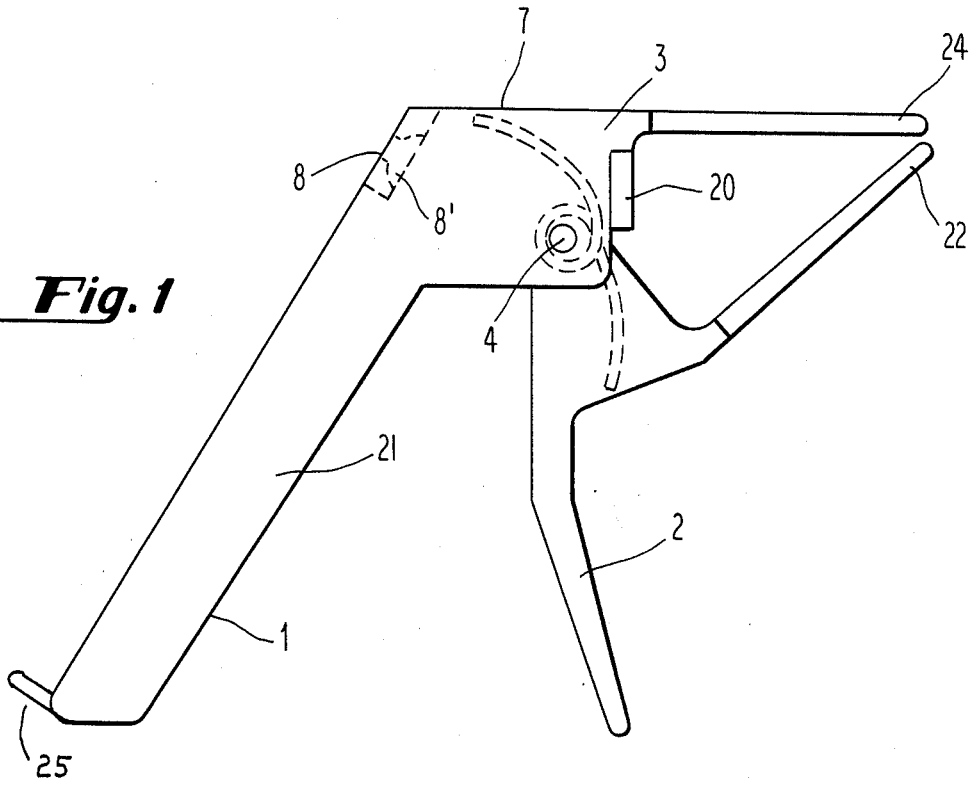
FIG. 1 is a side elevation view of the device of the present invention.
Figure 3:
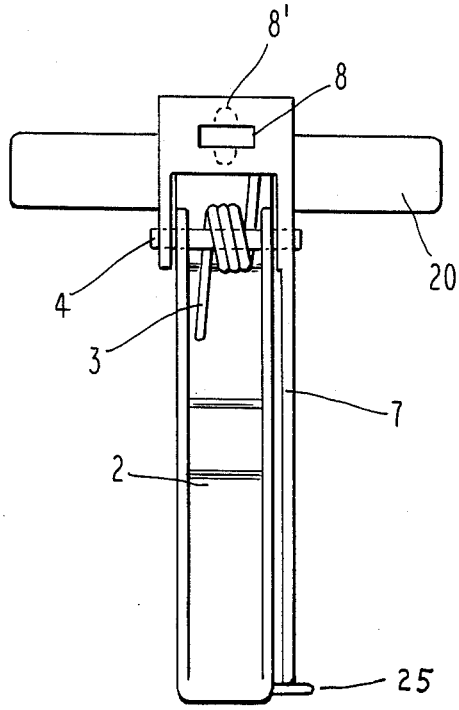
FIG. 3 is a rear view of the device of the present invention.
Figure 2:
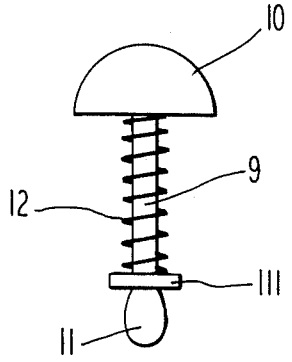
FIG. 2 is an elevation of the stud, 9 utilized in the present invention.

The basic structure is a two handled clamp type device. The lower handle, 2 has a grip portion, 21 and a clamp portion, 22. Member 25, as shown is a bottom holding pin which also assists in holding the workpiece in place. It is pivotally connected to upper handle, 1 which comprises a general L-shape with handle portion, 23 and clamp portion, 24. Pivot point, 4 serves as the hinge between handles, 1 and 2. Spring member, 3 is disposed between handles, 1 and 2 to resist opening of clamps, 22 and 24. In this way, the squeezing of handles in a pistol grip fashion as shown in FIG. 1, 1 and 2 cause clamps, 22 and 24 to open and relaxation of the pressure on handles, 1 and 2 allows closing of 22 and 24 on a table or work bench edge, (not shown). So disposed, the user is facing the device from the rear as shown in FIG. 3.

The device is stable in along the edge of the workbench or table via flange members 20 which lies along the table edge when the unit is disposed thereon. A cushion member such as a strip of rubber, felt or the like can be adhered to the face of member 20 to protect the bench or table edge from marring and to increase friction between member 20 and the table edge.

Attention is now directed at slots 8 and 81 defined in the body of handle 1 at a location where top body 7 meets grip portion 21. The upper slot 8 is rectangular in shape and the lower slot defined in the under side of handle 1 is cross-shaped.

Stud 9 is utilized to attach the work-piece to the device. It is comprised of stud top 10 and stud bottom 11 as shown in FIG. 2. Circumferentially disposed around the stud 9 between top 10 and bottom 11 is spring 12. Between spring 12 and bottom 11 is washer 111.

Bottom, 11 is accommodatingly smaller than top hole, 8 and the cross slot of bottom hole, 81 which is parallel to top hole, 8. The other slot of bottom hole, 81 is smaller. The user passes the bottom of stud, 9 through the work-piece which has an open weave consistency, a latch-hook rug, backer or the like. Then the stud is slid into hole, 8 and through hole, 81, washer, 111 slide up the shaft at stud 9 since it is accommodatingly larger than the hole 8. This compresses spring 12. When stud bottom 11 has passed through slot 8' it is rotated left or right ninety degrees (90°) which causes stud bottom 11 to rest against the edges of the slot 8' and remain via the tension of spring 12 against washer 111 and handle body 1. A series of devices along the work table thereby positions the work-piece at an angle equal to the angle formed by handle, 1 and the work bench to allow ease of access by the user. When the work-piece needs to be moved, the stud 9 is removed by reversing the simple procedure outlined above.

It is envisioned that the jaw members 22 and 24 can be coated with plastic or rubber or the like to protect the surface of the work bench or table and to increase friction between the members 22 and 24 and the work bench.

It is envisioned that various modifications can be made without departing from the scope of the present invention.

I claim as my invention:

1. A latch hook rug holder for attachment to a table or the like, comprising:

a. a first handle member comprising a first body portion and a first clamp portion;

b. a second L-shaped handle member, pivotally connected to said first handle portion, comprising a second body portion and a second clamp portion;

c. a spring interdisposed between said first handle member and said second L-shaped handle member which resists separation of the first clamp portion and the second clamp portion;

d. a two-sided opening defined in the second body portion of said second handle member which has a slot-type configuration, the outer side of the second body portion and a cross-shaped configuration on the inner side of the second body portion;

e. a stud member comprising a body, top flange and bottom flange wherein the bottom flange is accommodatingly smaller than the outer side of the two-sided opening;

f. a spring member circumferentially disposed along the stud member;

g. a washer disposed around the stud between the bottom flange and the spring wherein the washer is of a cross-sectional area larger than the outer side of the two-sided opening whereby a work-piece can be attached to a table by passing the stud through the work-piece and through the two-sided opening thereby attaching the work-piece to the holder and thereby the holder is clamped to a table edge.

2. The device of claim 1 wherein a series of holders is attached along the edge of a table or the like.

3. The device of claim 1 wherein a second stud member is fixedly attached to the outer edge of the L-shaped handle member whereby the work-piece is fixed along the outer edge of the device.

4. The device of claim 3 wherein said first and second clamp portions are coated with a soft material.

5. The device of claim 4 wherein said material is rubber.

6. The device of claim 4 wherein said material is soft plastic.

* * * * *